United States Patent [19]

Feldman

[11] 4,189,308

[45] Feb. 19, 1980

[54] HIGH VOLTAGE WETTED PARALLEL PLATE COLLECTING ELECTRODE ARRANGEMENT FOR AN ELECTROSTATIC PRECIPITATOR

[75] Inventor: Paul L. Feldman, Bridgewater, N.J.

[73] Assignee: Research-Cottrell, Inc., Somerville, N.J.

[21] Appl. No.: 956,266

[22] Filed: Oct. 31, 1978

[51] Int. Cl.[2] ..... B03C 3/08; B03C 3/12; B03C 3/16; B03C 3/78

[52] U.S. Cl. ..... 55/13; 55/119; 55/138; 55/146; 55/137

[58] Field of Search ..... 55/13, 118, 119, 136–138, 55/145, 146

[56] References Cited

U.S. PATENT DOCUMENTS

| | | | |
|---|---|---|---|
| 1,309,221 | 7/1919 | Schmidt | 55/119 |
| 2,354,457 | 7/1944 | Hamilton | 55/130 |
| 2,397,302 | 3/1946 | Viets | 55/119 |
| 2,476,903 | 7/1949 | Penney et al. | 55/13 |
| 2,998,098 | 8/1961 | McNall, Jr. et al. | 55/118 |
| 3,495,379 | 2/1970 | Hall et al. | 55/136 |
| 3,570,218 | 3/1971 | Finney, Jr. | 55/118 |
| 3,740,927 | 6/1973 | Vincent | 55/138 |
| 3,958,962 | 5/1976 | Hayashi | 55/138 |

*Primary Examiner*—David L. Lacey
*Attorney, Agent, or Firm*—Harold L. Stowell

[57] ABSTRACT

A wetted parallel plate collecting electrode arrangement which increases the maximum electric field intensity possible without having water draining off the lower edges of the collecting electrodes forming small droplets which are accelerated towards the opposite electrodes. An electrically conductive partition plate maintained at a voltage intermediate the voltages on the electrodes is disposed between the lower edges of oppositely charged electrodes and extends above and below the lower edges of the electrodes. Preferably, the partition plate is electrically "floating" and receives its voltage due to the effects of the electric field between the collecting electrodes.

6 Claims, 2 Drawing Figures

HIGH VOLTAGE WETTED PARALLEL PLATE COLLECTING ELECTRODE ARRANGEMENT FOR AN ELECTROSTATIC PRECIPITATOR

BACKGROUND OF THE INVENTION

This invention relates generally to a wetted parallel plate collecting electrode arrangement for an electrostatic precipitator, and more particularly to maximizing the intensity of the electrostatic collecting field to achive high particulate collection rates.

In two-stage electrostatic precipitators such as for cleaning industrial gas, particulate-laden gas is passed through a charging field produced by a corona discharge which electrically charges the suspended particles. The gas is then passed through a spatially separate electrostatic precipitating field produced between a pair of oppositely charged collecting electrodes, and individual charged particles are attracted to the collecting electrode having the opposite polarity. Typically, the collecting electrodes comprise a plurality of curtain-like plates, with alternate plates grounded and other alternate plates at a high negative or positive potential.

In such electrostatic precipitators, the collected particulate must be removed from the collecting electrodes, either continuously or periodically. One commonly employed approach is by mechanically "rapping" the collecting plates to dislodge the collected particulate so that it may fall into a collection bin. Another method of collected particulate removal is to continuously flow a liquid downwardly over the collection electrodes to carry away the collected particulate. A typical liquid is water. This "wet precipitator" method has an advantage in that there is less of a tendency towards reentrainment of particulate into the gas stream compared to the mechanical rapper method.

However, one drawback in the parallel-plate collecting section of two-stage wet precipitators is the water draining off the bottom edges of the collecting electrode plates tends to be accelerated under the influence of the strong electric field across the interelectrode space to the opposite electrode, thus causing sparking and premature limitation of the operating voltage. For the highest possible particulate collection rate, it is desirable to maximize the intensity of the electric collecting field. With conventional wetted parallel collecting electrode plates, the collecting fields have been found to be limited to approximately 12 KV per inch (4.7 KV per cm) before sparkover at moderate water flow rates. By way of contrast, in a dry collecting electrode configuration, the potential may be in excess of 16 KV per inch (6.3 KV per cm.) without sparking.

SUMMARY OF THE INVENTION

Accordingly, it is an object of the invention to maximize the intensity of the electric collection field to achieve high particulate collection rates in a wetted parallel plate electrostatic precipitator collecting electrode arrangement.

It is another object of the invention to reduce the tendency of water droplets to travel from the bottom edge of one plate to the other under the influence of the electrostatic field.

It is still another object of the invention to provide a wet precipitator collecting electrode arrangement which may be operated with an electric field intensity substantially in the order of the electric field intensity which may be employed in a comparable dry electrode arrangement.

Briefly stated, and in accordance with one aspect of the invention, these and other objects are accomplished by providing an electrically conductive partition plate between the lower edges of oppositely charged electrodes. The partition plate voltage is maintained intermediate the voltages on the oppositely charged electrodes, preferably by electrically insulating the partition plate from the collecting electrodes and from all other structures so that it is electrically "floating." Such a "floating" partition plate assumes the intermediate voltage due to the effects of the electric field between the collecting electrodes. Physically, the partition plate has a flat, elongated configuration, lies in a plane generally parallel to the planes of the collecting electrodes, and extends above and below the lower edges of the electrodes, leaving substantial portions of the electrodes exposed above the upper edge of the partition plate.

Alternatively, the partition plate may be directly supplied by a suitable power supply producing an output voltage at the proper intermediate voltage.

With the partition plate, the intensity of the collecting fields may be substantially increased, by approximately 35%. Collecting fields nearly as intense as can be achieved with dry collecting plates are possible. Additionally, it has been found that the rate of water flow over the collecting electrodes has minimal effect on the sparking characteristics and on the collecting field, thus allowing higher water flow rates if desired.

What is presently believed to be the mode of operation will now be described in the context of a commonly-employed collecting electrode configuration where the positively charged collecting elecrodes are connected to ground potential, and the negatively charged electrodes are connected to a high negative potential referenced to ground potential. Negatively charged water droplets attempt to migrate to the positive (grounded) electrodes under the influence of the electric field between two electrodes. A number of these water droplets are accumulated on the partition plates, which thereby become negatively charged. As a result, the horizontal component of the electric field in the gap between each negative collecting electrode and adjacent partition plate is weakened. Water droplets from the lower edge of the negative electrode are thus free to fall straight down. Water droplets leaving the positively charged (grounded) collection electrode, being positively charged, are deflected to the negatively charged partition plate, and then fall straight down. The positively charged water droplets from the positively-charged collection electrode, as well as water running down from the partition plate, both tend to neutralize partially some of the negative charges on the partition plate. Equilibrium is reached almost instantaneously to leave the partition plate with a net negative charge.

As the voltage on the collecting electrode varies, as typically occurs during operation of an electrostatic precipitator, the voltage on the partition plates varies also as new equilibrium points are established.

When the partition plate of the present invention is employed, the gap between the high negative voltage collecting electrode and the partition plate stays relatively dry to sustain high potential differences without sparking.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DETAILED DESCRIPTION OF THE DRAWINGS

Figure 1:
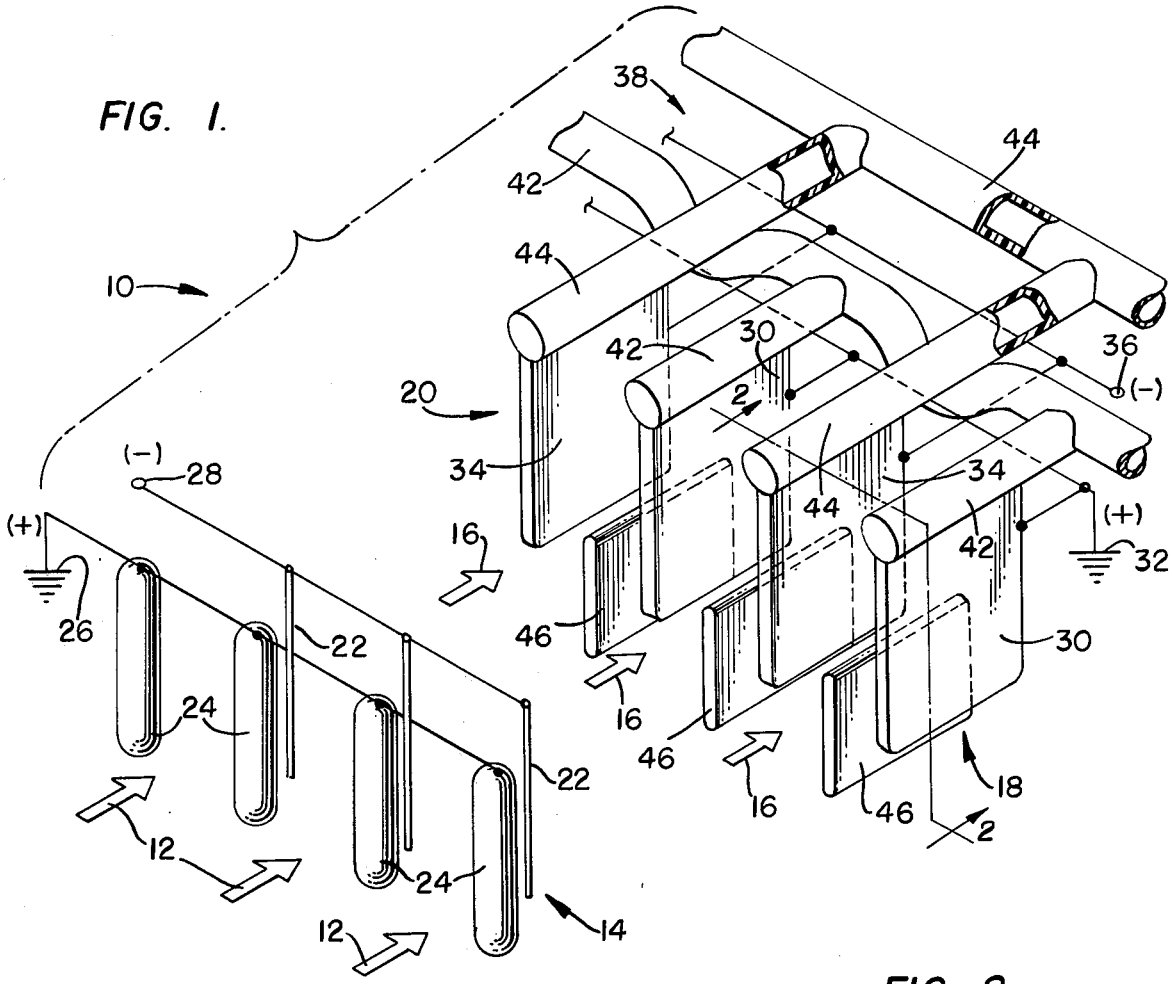
FIG. 1 is a perspective view showing essential elements of an electrostatic precipitator having a wetted parallel plate collecting electrode arrangement according to the present invention.

Referring first to FIG. 1, essential structure of a two-stage electrostatic precipitator 10 with wet collecting section electrodes is shown. While various supporting structures have been omitted for clarity of illustration, it will be appreciated that conventional support structures for the various illustrated elements are required, some supports electrically conducting and some electrically insulating. In FIG. 1, particulate-laden gas designated by arrows 12 flows into a first or charging section 14 of the precipitator 10 wherein the particles are ionized to generally carry a net negative charge. The gas stream then continues, as indicated by the arrows 16, into a second or collecting section 18 of the precipitator 10 wherein the charged particles are deposited on the surfaces of plate-like collecting electrodes 20, while the gas stream, relatively free of suspended particles, passes through. It will be appreciated that suitable ducting and gas stream moving means are required to properly direct the gas stream through the sections 14 and 18 of the precipitator 10.

The first or charging section 14 includes a plurality of discharging electrodes 22 and a plurality of oppositely charged non-discharging electrodes 24. The discharging electrodes 22, by virtue of their relatively small radii, have established therearound a sufficiently high potential gradient to produce a corona discharge. The non-discharging electrodes 24 are of extended surface area and all portions thereof located within the electric field are substantially free from sharp corners or other areas of sharp curvature. Conventionally, the non-discharging electrodes 24 are electrically grounded as indicated by a ground connection 26. This may be accomplished by directly tying these electrodes 24 to the structure or framework (not shown) of the precipitator 10. The discharging electrodes 22 are all connected to a high negative potential supplied at a terminal 28. Since a corona discharge surrounds the negatively charged discharging electrodes 22, the particulate carried by the entering gas stream generally receives a net negative charge.

In the collecting section 18, the collecting electrodes 20 of opposite polarity are alternately arranged. Positively charged collecting electrode plates 30 are connected to a ground connection designated 32 which, as in the case of the non-discharging electrodes 24, may be effected by a suitable direct metallic connection to the structure or framework of the precipitator 10. The alternate collecting electrodes 34 are negatively charged by means of connections to a terminal 36 supplied with a suitable high negative potential.

Conventionally, the collecting electrodes 20 have the plate-like configuration illustrated, but are much more extensive than might be apparent from the highly schematic illustration of FIG. 1. In large precipitators, the electrodes 20 resemble curtains, and are sometimes so termed.

In conventional electrostatic precipitator operation, particulate deposits on the surfaces of the collecting electrodes 20, particularly on the positively charged collecting electrodes 30, since the majority of the particles carry a net negative charge. However, there are always a small number of particles receiving a net positive charge in the charging section 14, or no charge at all, and these may collect on the surfaces of the negatively charged collecting electrodes 34.

In order to carry particulate away from the electrodes 20, liquid, preferably water, is caused to flow downwardly thereover. In the illustration, water is supplied through tubes 38 extending along the tops of the electrodes 20, with suitable apertures 40 (FIG. 2) provided in the tubes 38 to allow a controlled flow of liquid therefrom. Since the positively charged collecting electrodes 30 are connected to ground potential, any suitable piping and pumping arrangement may be employed for the tubes 42 supplying water for these electrodes. However, for the negatively charged collecting electrodes 34, an electrically insulated water supplying system must be employed. One particular arrangement found to be suitable is the use of plastic tubing 44, with high pressure air injected into the tubing 44 to produce a pumping action.

In the arrangement as thus far described, the intensity of the collecting electric field between the positively and negatively charged collecting electrodes 30 and 34 is limited by the tendency of water draining off the bottom edges of the collecting electrodes 20 to be accelerated under the influence of the strong electric fields across the inter-electrode spaces, thus causing sparking. Specifically, a phenomenon of electrical atomization occurs at the lower edges of the collecting electrodes 20. As the potential between the positively and negatively charged collecting electrodes 30 and 34 is raised, the water drop size becomes smaller and drops leave the electrodes 20 at higher velocities. At very high potentials, the drops actually disappear into a fine spray or mist consisting of charged droplets with a polarity similar to that on whichever of the collecting electrodes 20 from which they fall. When the potential across the electrodes 30 and 34 is raised too high, the inter-electrode space near the lower edges of the electrodes 20 loses its electrical resistance, and sparking occurs.

In accordance with the invention, an electrically conductive partition plate 46 is disposed between the lower edges of each pair of oppositely charged collecting electrodes. In FIG. 1, there are a plurality of partition plates 46, since there are a plurality of alternating polarity collecting electrodes 30 and 34. The partition plates 46 are disposed in a plane generally parallel to the planes of the collecting electrodes 20 and extend above and below the lower edges of the electrodes 20. Substantial portions of the electrodes 20 are exposed above the partition plates 46, and this is where the active precipitation field is established.

The partition plates 46 are electrically insulated both from the positively charged collecting electrodes 30 and from the negatively charged collecting electrodes 34. Additionally, the partition plates 46 are electrically insulated from all other structures. Thus, the partition plates 46 are electrically "floating." Accordingly, the support structure (not shown) for the partition plates 46 must be electrically insulating. With the arrangement, the partition plates receive a net negative charge due to the effect of the electric field maintained between the collecting electrodes 30 and 34 in the manner described above in the "Summary of the Invention."

Figure 2:
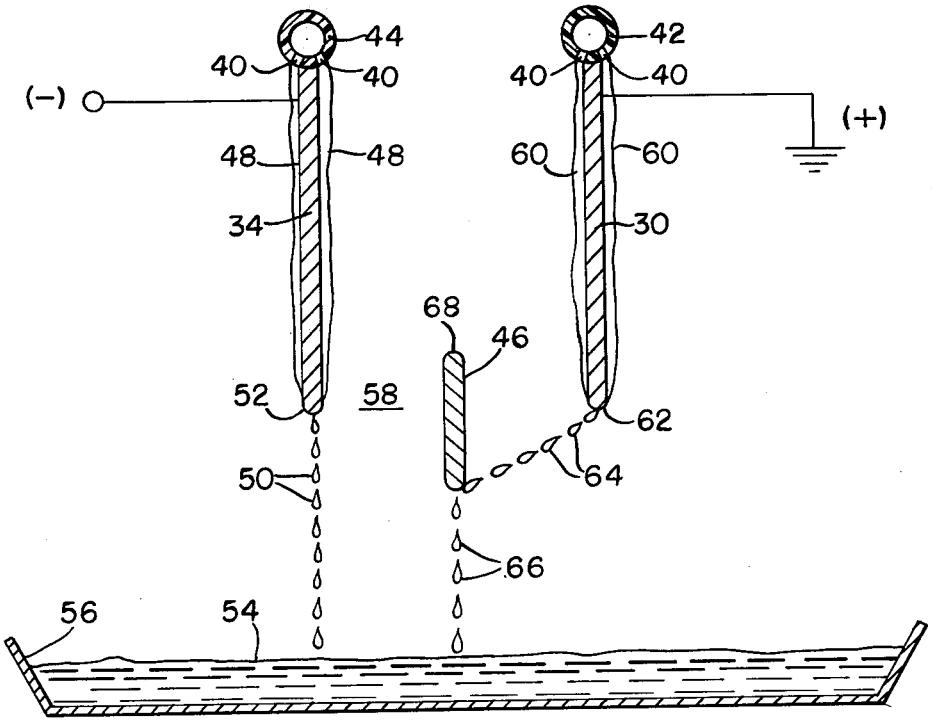
FIG. 2 is a section taken along line 2—2 of FIG. 1 showing the flow of water over and from a single pair of the collecting electrodes and intermediate partition plate.

Referring now additionally to FIG. 2, the flow of water over the electrodes 20 may more readily be seen. Water for the single negatively charged collecting electrode 34 shown in FIG. 2 flows from the plastic tube 44, over the surfaces of the electrode 34 in a flowing film, designated 48, and thereafter falls in the form of droplets 50 from the lower edge 52 of the electrode 34, ultimately reaching the upper surface 54 of water in a suitable reservoir 56. Due to the previously-described net negative charge on the partition plate 46, the horizontal component of the electric field in the gap, generally designated 58, between the negatively charged collecting electrode 34, and the partition plate 46 is greatly weakened. This permits the droplets 50 to fall straight down into the reservoir 56 under the influences of gravity and the vertical component of the electric field.

The conduit 42 supplying water over the single positively charged collecting electrode 30, shown in FIG. 2, similarly causes a film of water, designated 60, to flow over the surfaces of the electrode 30. At the bottom edge 62 of the collecting electrode 30, water droplets 64 carrying a net positive charge are deflected towards the negatively charged partition plate 46. Thereafter, the water droplets 66 are free to fall downward into the reservoir 56.

In one particular experimental embodiment, the upper edge 68 of the partition plate 46 was positioned one inch (2.5 cm.) above the lower edges 52 and 62 of the collecting electrodes 34 and 30. The overall height of the partition plate 46 was five inches (12.7 cm.). The collecting electrodes 30 and 34 were twenty inches (50.8 cm.) high and spaced three and three-fourths inches (9.5 cm.) apart. The lower edges 52 and 62 thereof were twelve inches (30.5 cm.) from the water surface 54. The partition plate 46 had a thickness of one-eighth inch (3.0 mm.) and was centered between the collecting electrodes 30 and 34, leaving a space of one and thirteen-sixteenth inch (4.6 cm.) between the partition plate 46 and each of the collecting electrodes 30 and 34.

In this particular experimental arrangement, the potential between the electrodes 30 and 34 could be raised to nearly 65 KV without serious sparking. With the three and three-fourths inch (9.5 cm.) gap, this corresponds to a collecting field on the order of 17.3 KV per inch (6.8 KV per cm.). It was found that water flow rate did not significantly influence the maximum voltage possible. With no water flow, and clean, dry plates spaced three and three-fourths (9.5 cm.) inches apart, at 62 KV a current density on the order of one to two milliamperes per 1000 square feet (93 sq. m.) of collecting area was measured, with no sparking. With water flowing at a rate on the order of 0.2 to 0.3 pounds of water per minute per square foot (9.8 to 14.7 kg. per minute per sq. m.) of collecting area, the current density increased to about 15 to 30 milliamperes per 100 square feet (93 sq. m.) of collecting area of 62 KV, with only marginal sparking at the rate of 5 to 10 mild sparks per minute.

From the foregoing it will be apparent that there has been provided an apparatus and method for maximizing the operating voltage of an electrostatic precipitator having wetted collecting plates. In particular, an electrically-floating partition plate parallel to the bottom of the collecting electrode and extending upward between electrodes for a short distance just adequate to prevent droplets from bridging the gap between the electrodes provide substantial benefits.

While not illustrated, it will be apparent that, if desired, a suitable intermediate voltage may be directly supplied to the partition plate 46, rather than by allowing the plates 46 to electrically "float." This approach, however, would not be without disadvantage, as a more complicated power supply arrangement would be required and means for varying the partition plate voltage as the collecting electrode voltage varied would be required.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. A wetted parallel plate collecting electrode arrangement for an electrostatic precipitator, said arrangement comprising:

a source of high negative potential referenced to ground potential;

a pair of generally parallel plate-like electrodes having generally parallel lower edges;

electrical conductors connecting opposite of said plate-like electrodes to said source of high negative potential and to ground potential;

means for flowing a liquid film downwardly over a surface of at least one of said electrodes;

a flat, elongated, electrically conductive partition plate disposed between the lower edges of said electrodes in a plane generally parallel to the planes of said electrodes, and means maintaining said partition plate at a voltage intermediate the voltages on said electrodes; and wherein said partition plate extends above and below the lower edges of said electrodes, and substantial portions of said electrodes are exposed above said partition plate.

2. A collecting electrode arrangement according to claim 1, wherein the liquid is water.

3. A collecting electrode arrangement according to claim 1, wherein said maintaining means comprises electric insulation; and said partition plate is electrically insulated by said insulation from both of said electrodes and from all other structure.

4. A wetted parallel plate collecting electrode arrangement for an electrostatic precipitator, said arrangement comprising:

a source of high negative potential referenced to ground potential;

a pair of generally parallel plate-like electrodes for the collection of charged particulate carried by a gas stream passed between said electrodes, electrical conductors connecting opposite of said plate-like electrodes to said source of high negative potential and to ground potential so as to provide said electrodes with respectively positively and negatively electrical charge relative to each other with an electric field developed therebetween, and said electrodes having generally parallel lower edges;

means flowing water downwardly over said electrodes for carrying away collected particulate, the water tending to atomize into droplets at the lower edge of at least one of said electrodes and tending to travel towards the other of said electrodes;

electric insulation; and an electrically conductive partition plate for reducing the travel of water droplets between said electrodes, said partition plate having a flat elongated configuration, disposed between the lower edges of said electrodes, and electrically insulated by said electric insulation from said electrodes;

said partition plate acquiring an electric charge similar to the charge on said other of said electrodes, and horizontal electric field component being reduced in the region between said partition plate and said other of said electrodes;

whereby water droplets from the lower edge of said one of said electrodes are attracted to said partition and then fall substantially directly downward.

5. A method for reducing the tendency of atomized liquid droplets to travel from the lower edge of one of the parallel plate electrodes of an electrostatic precipitator parallel plate collecting section to the other of the parallel plate electrodes, the two parallel plate electrodes being oppositely charged, said method comprising the step of intercepting the liquid droplets by means of an electrically conductive partition plate which is disposed between the lower edges of the parallel plate electrodes and which has a voltage intermediate the voltage on the two parallel plate electrodes.

6. A method according to claim 5, wherein the conductive partition plate is electrically insulated from both of the parallel plate electrodes and from all other structure, and the partition plate assumes the intermediate voltage due to the effects of the electric field maintained between the two parallel plate electrodes.

* * * * *